US007610662B2

(12) United States Patent
Ausnit

(10) Patent No.: US 7,610,662 B2
(45) Date of Patent: Nov. 3, 2009

(54) LEAKPROOF SLIDER ZIPPER

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 239 days.

(21) Appl. No.: 11/599,960

(22) Filed: Nov. 15, 2006

(65) Prior Publication Data

US 2008/0110001 A1 May 15, 2008

(51) Int. Cl.
*A44B 19/26* (2006.01)
*B65D 33/25* (2006.01)
*A44B 19/16* (2006.01)

(52) U.S. Cl. ..... 24/400; 24/415; 24/30.5 R; 24/427; 383/64

(58) Field of Classification Search ..... 24/30.5 R, 24/415, 427, 385, 585.1, 585.12, 585.11; 383/64

See application file for complete search history.

(56) References Cited

U.S. PATENT DOCUMENTS 3,173,184 A 3/1965 Ausnit
3,220,076 A 11/1965 Ausnit et al.
5,020,194 A * 6/1991 Herrington et al. ..... 24/400
6,088,887 A * 7/2000 Bois ..... 24/585.12
6,305,844 B1 * 10/2001 Bois ..... 24/399
6,461,042 B1 10/2002 Tomic et al.
6,761,481 B1 7/2004 Bois
2004/0010893 A1 1/2004 Kasai
2004/0045138 A1 3/2004 Kasai
2004/0136618 A1 * 7/2004 Ausnit et al. ..... 383/64
2004/0161169 A1 * 8/2004 Fenzl et al. ..... 24/399
2006/0210201 A1 * 9/2006 Ackerman et al. ..... 383/64
2007/0000098 A1 1/2007 Ausnit

FOREIGN PATENT DOCUMENTS

EP 1 418 132 A 5/2004
EP 1 449 783 A 8/2004

* cited by examiner

*Primary Examiner*—Robert J Sandy
(74) *Attorney, Agent, or Firm*—Day Pitney LLP

(57) ABSTRACT

The present disclosure relates to a leakproof or leak-resistant slider zipper for reclosable packages or bags wherein the zipper profiles include upper flanges which are captured within horizontal channels of the slider. The horizontal channels are configured to be closer to each other at the closing end than at the opening end so as to urge the zipper profiles together at the closing end and apart at the opening end. The zipper profiles further include complementary interlocking elements as well as a lower bead and flap configuration wherein the flap remains urged against the bead in a leakproof or leak-resistant configuration throughout the entire length of the slider.

20 Claims, 5 Drawing Sheets

LEAKPROOF SLIDER ZIPPER

BACKGROUND OF THE INVENTION

1. Field of the Invention

The present invention relates to a leakproof or leak-resistant slider zipper for a reclosable package.

2. Description of the Prior Art

In the prior art, slider zippers for reclosable packages or bags are well-developed. While these slider zippers have proven satisfactory for their intended purposes, further improvements are desired with respect to maintaining the leakproof integrity of such reclosable packages or bags. As recognized in U.S. Pat. No. 6,761,481 entitled "Bag Comprising Matching Closing Sections Actuated by a Slider" and its numerous progeny applications, certain deficiencies in the sealing process can occur when the zipper profiles or strips remain in a separated configuration ahead of the slider. This can be problematic for reclosable bags which contain liquids, gels, fine particulates or frozen foods. While this has been addressed by the present inventor in U.S. patent application Ser. No. 11/173,545, entitled "Leakproof Fastener With Slider" filed on Jul. 7, 2005, still further improvements are sought.

Related prior art by the present inventor likewise includes U.S. Pat. No. 3,173,184 entitled "Shaped Head Top Closure" and U.S. Pat. No. 3,220,076 entitled "Slide Fastener".

OBJECTS AND SUMMARY OF THE INVENTION

It is therefore an object of the present invention to provide improvements in the leakproof characteristics of slider zippers for reclosable packages.

This and other objects are attained by a leakproof slider zipper wherein zipper profiles include upper flanges, intermediate interlocking elements and a lower leakproof structure, such as a bead and flap. The slider includes a horizontal bar that forms grooves within the slider top. The upper flanges of the zipper profiles ride these grooves. The horizontal bar is wide enough at the opening end of the slider to force the interlocking elements apart by urging the upper flanges of the zipper profiles away from each other. The horizontal bar and the side walls taper along the length of the slider to force the interlocking elements together toward the closing end of the slider. Moreover, the lower portions of the slider walls taper toward each other, reaching maximum taper at the opening end of the slider in order to maintain the leakproof configuration, despite the divergence of the slider sides.

While a separating finger extending between the interlocking elements is typically not necessary, such a separating finger can be added in alternative embodiments.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENTS

Figure 1:
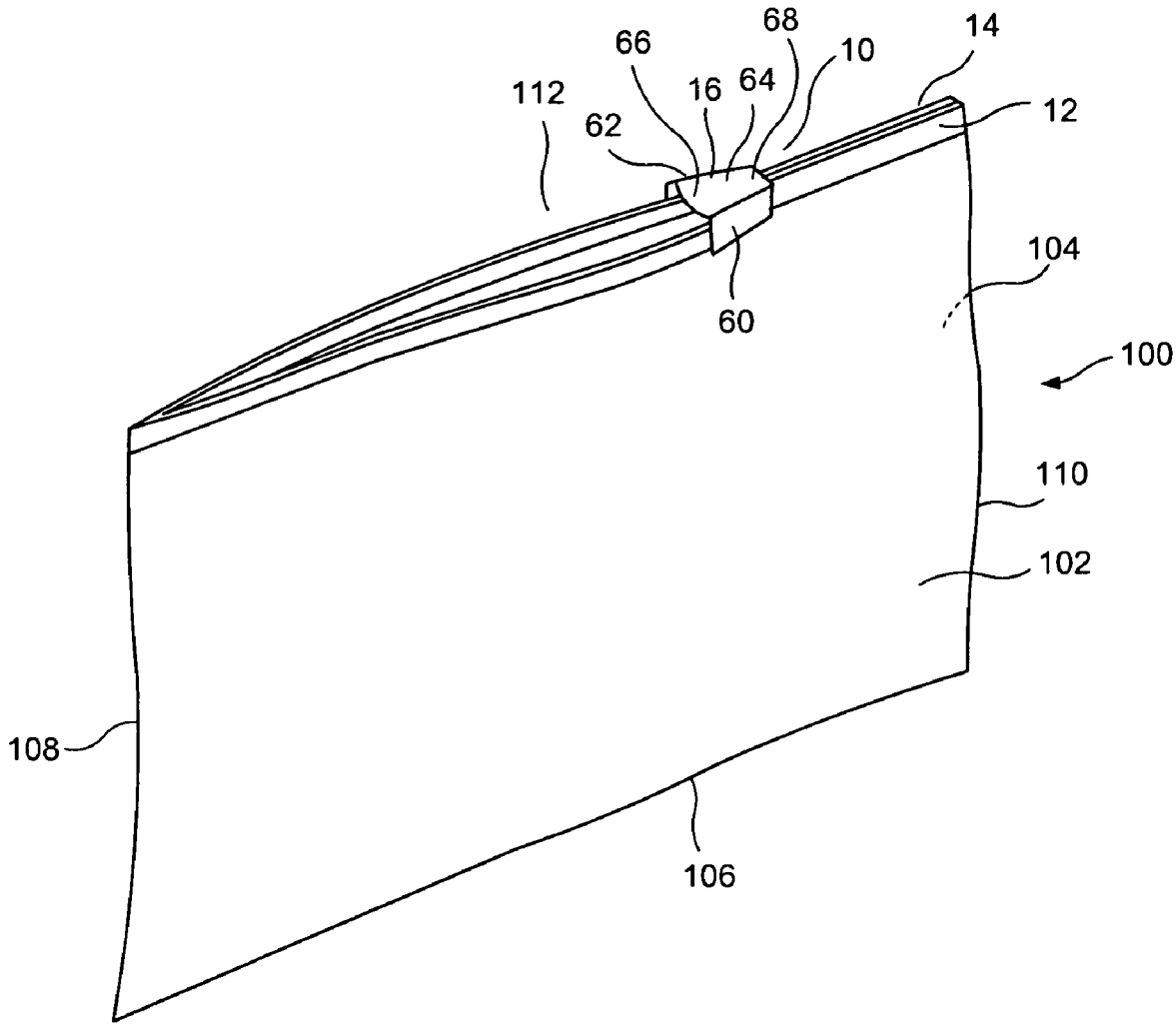
FIG. 1 is a perspective view of a reclosable package or bag including the slider zipper of the present invention.
Figure 2:
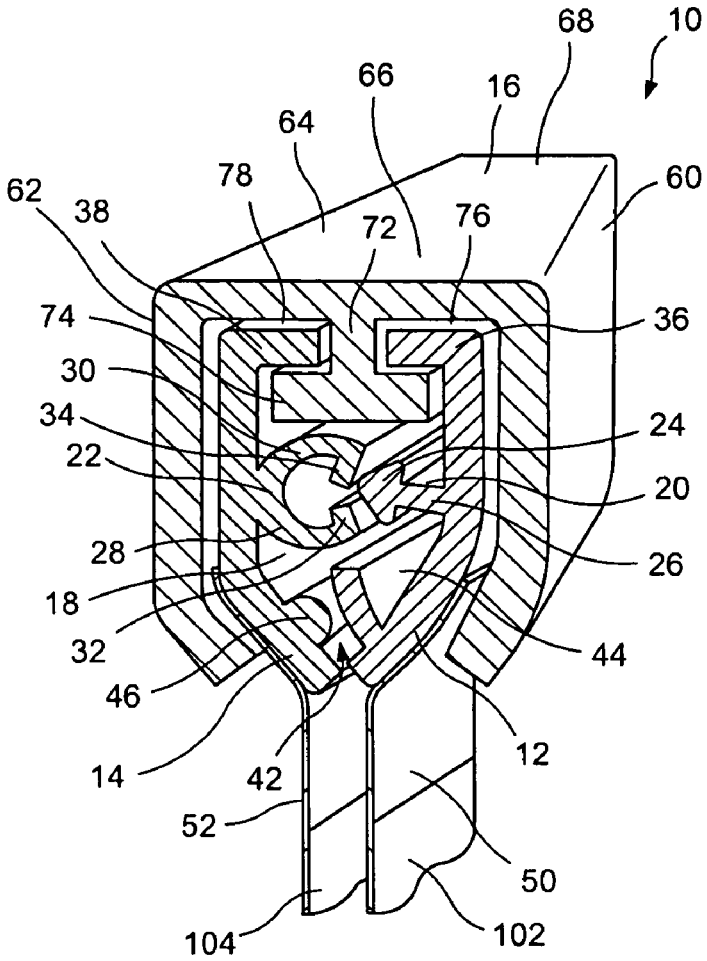
FIG. 2 is a perspective view of the opening end of the slider and the zipper profiles of the present invention.
Figure 3:
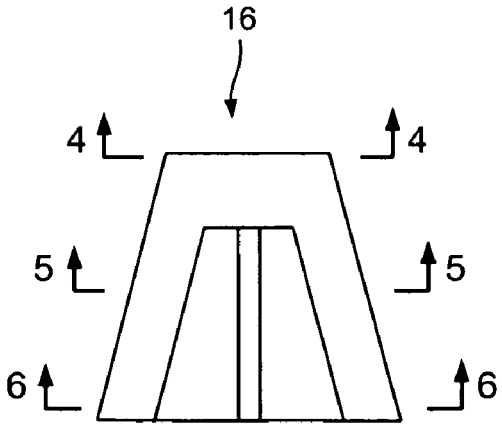
FIG. 3 is a top view of the slider of the zipper of the present invention.

Referring now to the drawings in detail wherein like numerals refer to like elements throughout the several views, one sees that FIG. 1 is a perspective view of a typical reclosable package or bag 100 which includes the slider zipper 10 of the present invention. Bag 100 includes front and rear walls 102, 104 of polymeric or similar film which are sealed together by a bottom seal 106 and side seals 108, 110 thereby forming a mouth 112, which is selectively openable and closable by zipper 10. In some embodiments, bottom seal 106 or seals 108, 110 can be replaced by a fold formed in a single sheet of polymeric film thereby forming front and rear walls 102, 104.

As generally shown in FIG. 1 and as shown more specifically in the subsequent figures, polymeric zipper 10 includes first profile 12, second profile 14 and slider 16. Interlocking structure 18 is formed by a male element 20 in a central location in first profile 12 and a female element 22 in a central location in second profile 14. Male element 20 is formed from arrowhead structure 24 on shaft 26. Female element 22 is formed from outwardly extending arms 28, 30 with detent hooks 32, 34 of the respective distal ends thereof. First and second upper inwardly extending flanges 36, 38 are formed on the top of respective first and second profiles 12, 14 and face each other. Leakproof structure 42 is formed by flap 44 at a lower portion of first profile 12 and semi-cylindrical bead 46 at a lower portion of second profile 14. As can be seen from FIGS. 4, 5 and 6, flap 44 impinges resiliently against bead 46 throughout the range of relative positions of the first and second profiles 12, 14 within slider 16 so as to maintain a leak-resistant or leakproof configuration throughout the entire slider 16. Slider 16 operates to interlock male and female elements 20, 22 of respective first and second profiles 12, 14 when moved in a first or closing direction and to separate male and female elements 20, 22 of respective first and second profiles 12, 14 when moved in a second or opening direction.

As shown in FIG. 1, slider 16 includes first and second side walls 60, 62 and top wall 64. First and second sidewalls 60, 62 are tapered apart from each other so as to form opening end 66 wherein the first and second sidewalls 60, 62 are relatively further apart and wherein first and second profiles 12, 14 are sufficiently spread apart to separate (see FIG. 6) and likewise so as to form closing end 68 wherein first and second sidewalls 60, 62 are relatively closer together and wherein first and second profiles 12, 14 are sufficiently close that arrowhead structure 24 of male element 20 is guided into and captured by female element 22.

Figure 6:
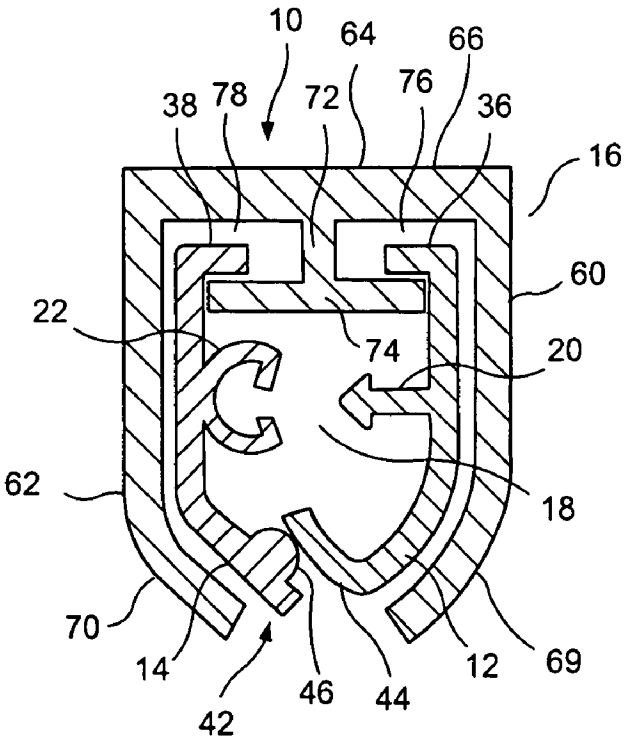
FIG. 6 is a cross-sectional view along plane 6-6 of FIG. 3, showing the opening end of the slider of the zipper of the present invention.
Figure 5:
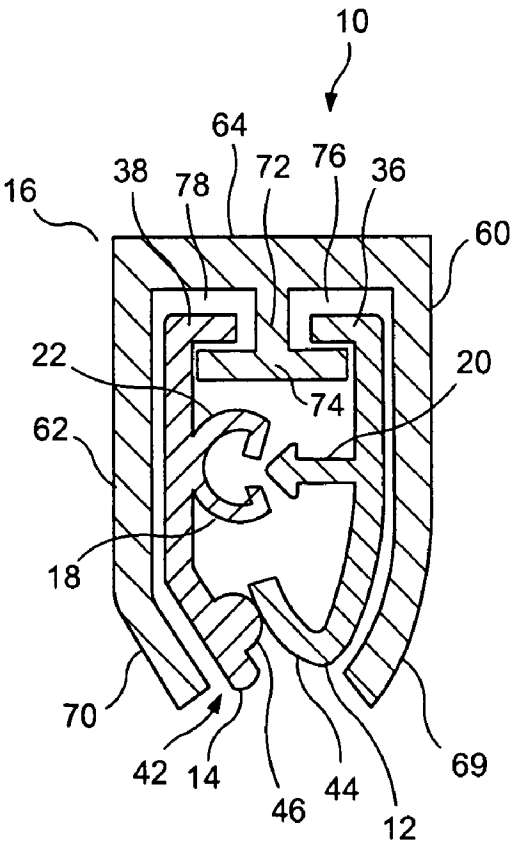
FIG. 5 is a cross-sectional view along plane 5-5 of FIG. 3, showing a central portion of the slider of the zipper of the present invention.
Figure 4:
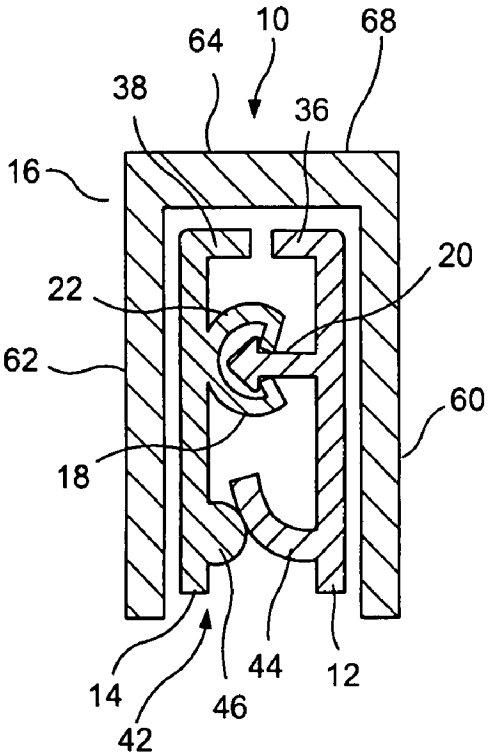
FIG. 4 is a cross-sectional view along plane 4-4 of FIG. 3, showing the closing end of the slider of the zipper of the present invention.

As shown in FIGS. 4, 5 and 6, in order to maintain flap 44 against bead 46 thereby maintaining the leakproof or leak-resistant configuration through the increasing width of the entire length of slider 16, first and second sidewalls 60, 62 further include respective lower inwardly tapering sides 69, 70 which taper slightly at central or interior locations (FIG. 5) and progress to a more pronounced taper at opening end 66 (FIG. 6).

Vertical stem 72 extends downwardly from top wall 64 to support horizontal divider bar 74 thereby forming horizontal channels 76, 78 immediately below top wall 64. Upper inwardly extending flanges 36, 38 are captured within horizontal channels 76, 78. The width of horizontal divider bar 74 (and therefore the width of horizontal channels 76, 78) is at its maximum at opening end 66 (FIG. 6) in order to separate the first and second interlocking profiles 12, 14 from one another. The horizontal divider bar 74 tapers to a reduced width at the interior location of FIG. 7 to allow male element 20 to approach female element 22. The horizontal divider bar 74 tapers further so as to be absent from closing end 68 thereby allowing first and second side walls 60, 62 to urge first and second profiles 12, 14 together so that male element 20 is urged into and captured by female element 22 as shown in FIG. 4.

First and second profiles 12, 14 further include lower flanges 50, 52 for attachment to rear and front walls 102, 104 of package or bag 100.

Figure 7:
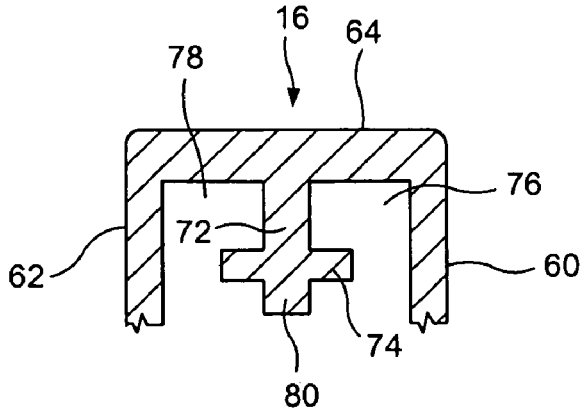
FIG. 7 is a cross-sectional view of a first alternative embodiment of the slider of the zipper of the present invention, wherein a separator finger extends downwardly from the horizontal bar.

The embodiment of FIGS. 1-6 does not include separator finger inserted between male element 20 and female element 22. However, FIG. 7 illustrates a first alternative embodiment wherein a separator finger 80 extends downwardly from horizontal divider bar 74 so as to be inserted between male element 20 and female element 22 proximate to opening end 66 of slider 16 thereby assisting in separating male element 20 and female element 22.

Figure 9:
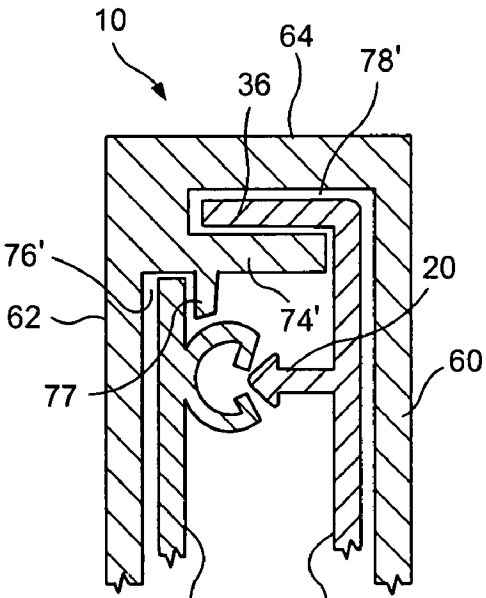
FIG. 9 is a cross-sectional view of the opening end of the second alternative embodiment of the slider of the zipper of the present invention.
Figure 8:
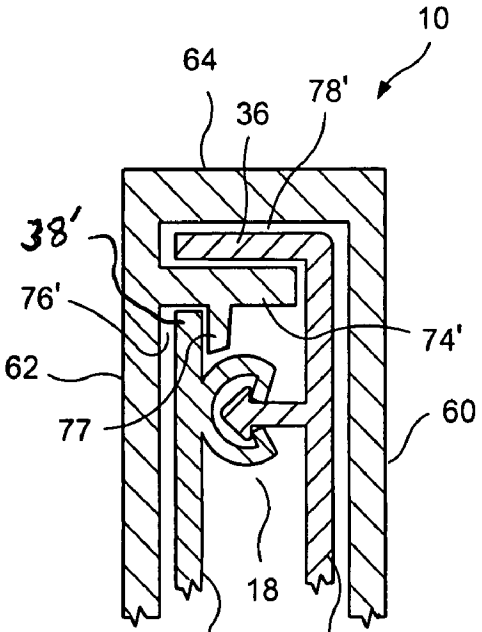
FIG. 8 is a cross-sectional view of the closing end of a second alternative embodiment of the slider of the zipper of the present invention, wherein the horizontal groove extends from a single side wall of the slider.

FIGS. 8 and 9 illustrate the closing and opening ends, respectively, of a second alternative embodiment wherein a single divider horizontal bar 74' extends from second sidewall 62 to form a horizontal channel 78' to capture upper inwardly extending flange 36 of first profile 12. Second profile 14 does not include an upper inwardly extending flange. However, finger 77 extends downwardly from divider horizontal bar 74' to form vertical channel 76' which captures an upwardly extending flange 38' of second profile 14. As shown in FIG. 9, horizontal divider bar 74' extends sufficiently across the opening end 66 of slider 16 to urge the first and second profiles 12, 14 apart. A leakproof or leak-resistant configuration, such as the flap 44 and bead 66 of FIGS. 2 and 4-6, is included in all of the illustrated embodiments.

Figure 10:
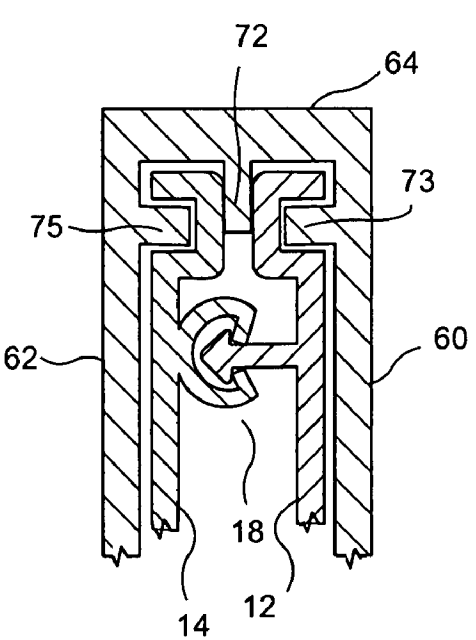
FIG. 10 is a cross-sectional view of the closing end of a third alternative embodiment of the slider of the zipper of the present invention, wherein the horizontal grooves extend from the sidewalls of the slider.
Figure 11:
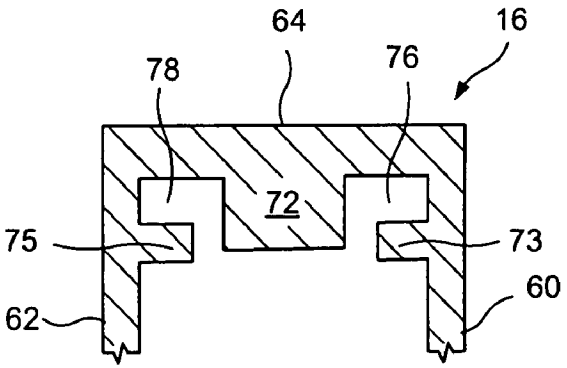
FIG. 11 is a cross-sectional view of the opening end of the third alternative embodiment of the slider of the zipper of the present invention.

FIGS. 10 and 11 illustrate the closing and opening ends, respectively, of a third alternative embodiment wherein horizontal divider bar segments 73, 75 extend from respective first and second sidewalls 60, 62 to form horizontal channels 76, 78 which are separated by vertical stem 72. Upper flange 36 has a C-shaped cross section and upper flange 38 has a reversed C-shaped cross section. As in all embodiments, horizontal channels 76, 78 are oriented to be relatively closer together at the closing end 68 as shown in FIG. 10 than at the opening end 66 as shown in FIG. 11. Vertical stem 72, which separates horizontal channels 76, 78 is therefore thicker at the opening end 66 than at the closing end 68.

Figure 12:
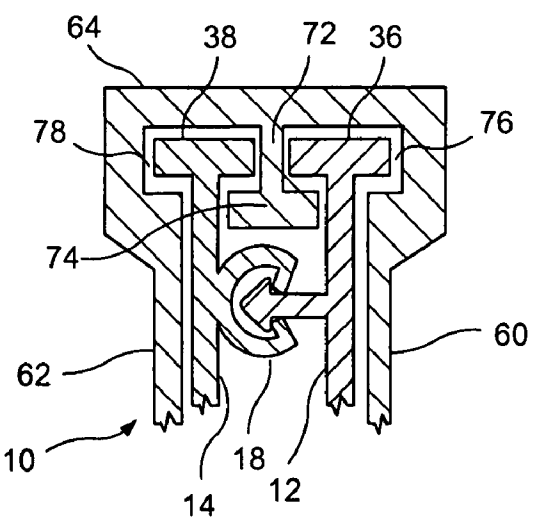
FIG. 12 is a cross-sectional view of the closing end of a fourth alternative embodiment of the slider of the zipper of the present invention, wherein the upper flanges of the zipper profiles are T-shaped and corresponding horizontal grooves are formed in the slider.
Figure 13:
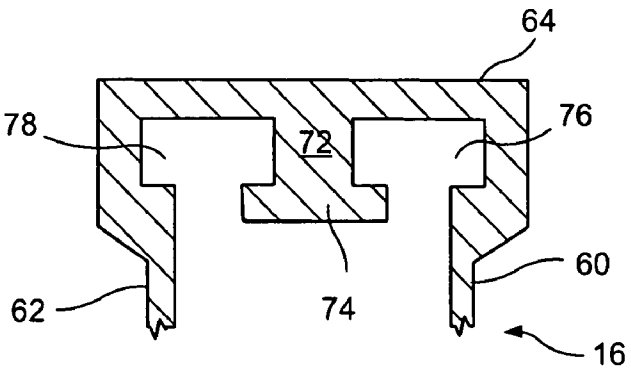
FIG. 13 is a cross-sectional view of the opening end of the fourth alternative embodiment of the slider of the zipper of the present invention.

FIGS. 12 and 13 illustrate the closing and opening ends, respectively, of a fourth alternative embodiment wherein upper flanges 36, 38 are T-shaped and horizontal channels 76, 77 are complementarily shaped.

Figure 14:
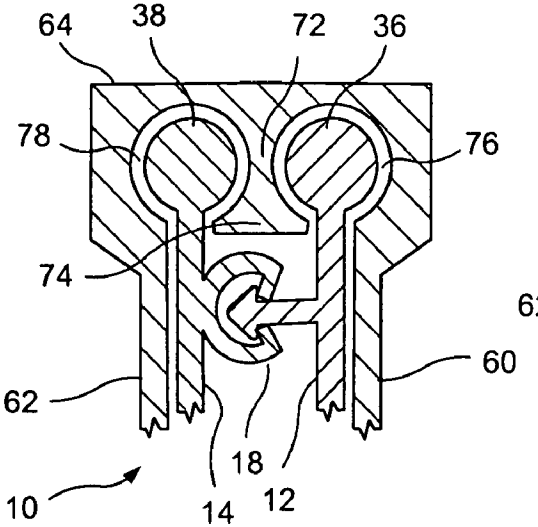
FIG. 14 is a cross-sectional view of the closing end of a fifth alternative embodiment of the slider of the zipper of the present invention, wherein the upper flanges of the zipper profiles are cylindrical and the horizontal grooves are formed as cylindrical channels.

FIG. 14 illustrates the closing end of a fifth alternative embodiment wherein upper flanges 36, 38 are cylindrically shaped and horizontal channels 76, 78 are complementarily shaped.

Figure 15:
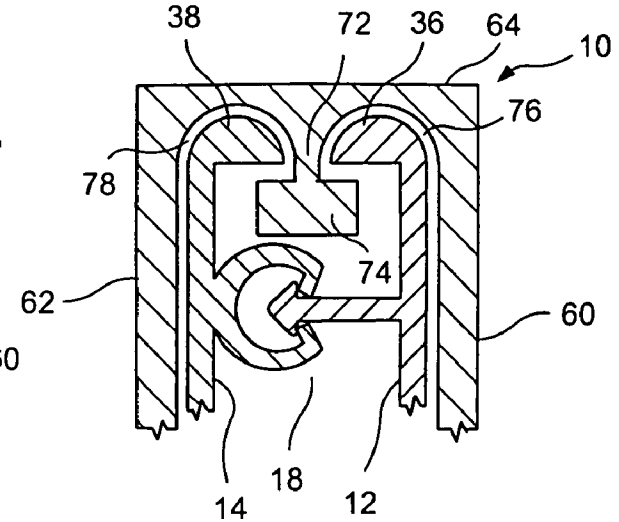
FIG. 15 is a cross-sectional view of the closing end of a sixth alternative embodiment of the slider of the zipper of the present invention, wherein the upper flanges of the zipper profiles are inwardly extending semi-cylindrical structures and the horizontal grooves are formed as semi-cylindrical channels.
Figure 16:
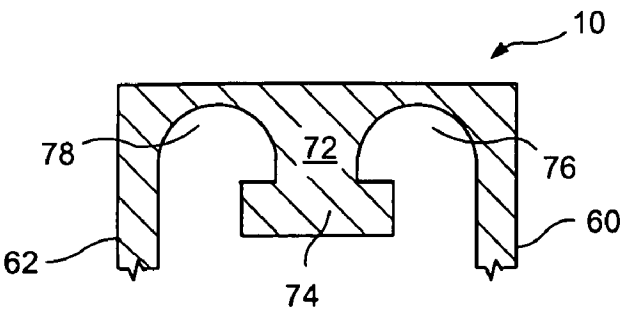
FIG. 16 is a cross-sectional view of the opening end of the sixth alternative embodiment of the slider of the zipper of the present invention.

FIGS. 15 and 16 illustrate the closing and opening ends, respectively wherein upper flanges 36, 38 are semi-cylindrically shaped and horizontal channels 76, 78 are complementarily shaped.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper for a reclosable package or bag, comprising:

a first zipper profile with a first interlocking element, a first flange and a first leak-resistant element;

a second zipper profile with a second interlocking element, a second flange and a second leak-resistant element; and a slider including first and second channels capturing the respective first and second flanges above the first and second interlocking elements whereby the first and second interlocking elements are below the first and second channels, the slider including an opening end wherein the channels are spaced apart so as to separate the first and second zipper profiles and a closing end wherein the channels are spaced apart so as to interlock the first and second zipper profiles, whereby when the slider is moved in a first direction, the first and second zipper profiles are interlocked with each other and when the slider is moved in a second direction, the first and second zipper profiles are separated from each other;

the slider further including first and second side walls which include tapered portions to maintain contact between the first leak-resistant element and the second leak-resistant element throughout an entire length of the slider.

2. The zipper of claim 1 wherein one of the first and second leak-resistant elements includes a semi-cylindrical protrusion.

3. The zipper of claim 2 wherein another of the first and second leak-resistant elements includes a flap protrusion urged against the semi-cylindrical protrusion by the tapered portions.

4. The zipper of claim 3 wherein the first interlocking element is positioned between the first flange and the first leak-resistant element and wherein the second interlocking element is positioned between the second flange and the second leak-resistant element.

5. The zipper of claim 1 wherein one of the first and second interlocking elements is a male element and another of the first and second interlocking elements is a female element complementary to the male element.

6. The zipper of claim 5 wherein the male element is arrowhead shaped with a shaft.

7. The zipper of claim 5 wherein the female element has two outwardly extending arms for capturing the male element.

8. The zipper of claim 7 wherein detent hooks are formed on distal ends of the outwardly extending arms.

9. The zipper of claim 1 wherein the first and second channels are formed by a divider bar formed parallel to a top wall of the slider.

10. The zipper of claim 9 wherein the divider bar is supported by a stem extending from a top wall of the slider.

11. The zipper of claim 10 wherein the stem separates the first channel from the second channel.

12. The zipper of claim 11 wherein the divider bar is free of a separator extending from the divider bar to a position between the first and second interlocking elements.

13. The zipper of claim 9 wherein the divider bar includes a separator extending between the first and second interlocking elements.

14. The zipper of claim 1 wherein the first and second flanges extend inward toward each other.

15. The zipper of claim 1 wherein the first and second channels are formed by respective first and second divider bar segments extending from respective first and second side walls of the slider.

16. The zipper of claim 1 wherein the first and second flanges have a C-shaped cross section.

17. The zipper of claim 1 wherein the first and second flanges have a T-shaped cross section.

18. The zipper of claim 1 wherein the first and second flanges have a cylindrical cross section.

19. The zipper of claim 1 wherein the first and second flanges have a semi-cylindrical cross section.

20. A zipper for a reclosable package or bag, comprising:

a first zipper profile with a first interlocking element, a first flange and a first leak-resistant element;

a second zipper profile with a second interlocking element, a second flange and a second leak-resistant element; and a slider including first and second channels capturing the respective first and second flanges above the first and second interlocking elements whereby the first and second interlocking elements are below the first and second channels, the slider including an opening end wherein the channels are spaced apart so as to separate the first and second zipper profiles and a closing end wherein the channels are spaced apart so as to interlock the first and second zipper profiles, whereby when the slider is moved in a first direction, the first and second zipper profiles are interlocked with each other and when the slider is moved in a second direction, the first and second zipper profiles are separated from each other;

the slider further including first and second side walls which include tapered portions to maintain contact between the first leak-resistant element and the second leak-resistant element throughout an entire length of the slider; and wherein the first channel is formed by a divider bar extending from one of the side walls and formed parallel to a top wall of the slider and wherein the second channel is formed by a finger extending from the divider bar parallel to the side walls.

* * * * *